United States Patent [19]

Hempel

[11] Patent Number: 4,502,368

[45] Date of Patent: Mar. 5, 1985

[54] AIR VENT COVER

[76] Inventor: George T. Hempel, 139 Shady Brook, DeSoto, Tex. 75115

[21] Appl. No.: 523,106

[22] Filed: Aug. 15, 1983

[51] Int. Cl.[3] ..... F24F 7/00

[52] U.S. Cl. ..... 98/29; 98/119; 248/27.1; 248/223.2; 292/300

[58] Field of Search ..... 98/29, 32, 37, 88 R, 98/99.1, 99.2, 99.3, 99.4, 99.5, 99.8, 101, 103, 108; 292/301, 302, 342, 300; 403/406, 405, 407, 408; 248/27.1, 56, 223.2

[56] References Cited

U.S. PATENT DOCUMENTS

| | | | |
|---|---|---|---|
| 2,380,782 | 7/1945 | Owens | 292/302 X |
| 2,802,410 | 8/1957 | Robinson | 98/37 X |
| 2,834,278 | 5/1958 | Crute, Jr. | 98/29 |
| 3,130,659 | 4/1964 | Compton et al. | 98/29 |
| 4,026,082 | 5/1977 | Crofoot | 98/37 |

FOREIGN PATENT DOCUMENTS

| | | | |
|---|---|---|---|
| 548080 | 9/1942 | United Kingdom | 98/99.2 |

*Primary Examiner*—Harold Joyce

*Attorney, Agent, or Firm*—H. Mathews Garland

[57] ABSTRACT

A cover for an air vent opening in a building comprising a generally rectangular housing portion have a central panel, side and end walls, and provided with a mounting peripheral flange formed by side and end flanges extending in a plane substantially parallel with the plane of the central panel portion of the vent enclosure part of the cover. The end flanges are provided with keyways having round portions and narrower slot portions through the end flanges along a latching surface in each of the flanges which is an inclined plane providing a flange thickness greater along the slotted than along the round portions of the keyways. The cover is held in place by screws fitting through the keyways and wedged with the latch surfaces on the end flanges of the cover by moving the cover laterally.

4 Claims, 5 Drawing Figures

AIR VENT COVER

This invention relates to covers for air vents and more specifically relates to covers for air vents opening into commercial and residential buildings.

Building structures, both residential and commercial, are commonly designed with air vents opening into attic spaces above the building ceilings and into crawl spaces below the building floors. The crawl space vents normally are in the vertical side walls of a building. The attic vents may be in the side walls of the building beneath the eaves or, in the case of boxed-in or closed eaves, the vents are ordinarily in the downwardly facing horizontal surfaces of the panels which enclose the eaves. Where blowing rain and snow are not a problem the air vents normally are covered with some form of screen wire or mesh to keep out insects and animals from the attics and crawl spaces. Where it is necessary to exclude blowing snow and rain louvers are installed over the vents. Ordinarily during those times of the year when refrigerated air conditioning is required for building comfort, the vents are left open to provide maximum air flow through the crawl spaces and attics. In those geographical areas where heating is required during the cooler periods, it is desirable to cover the vents to improve the efficiency of the heating systems in the buildings and to reduce energy costs which have become an extremely significant portion of building operation in recent energy short years. One form of vent cover which has been known in the past is a simple rectangular plate having a central screw hole through which a threaded shoe shank extends from the center of the vent frames opening into building crawl spaces. Covers have not, however, been available for vents provided with louvres and vents not having the customary frame used in vents opening into crawl spaces. No covers are known to be available particularly for attic vents located under building eaves.

It is therefore a principal object of the present invention to provide a cover for an air vent in a building.

It is another object of the invention to provide an air vent cover for a building adapted to fit over a louvre installed in the air vent.

It is another object of the invention to provide an air vent cover which is inexpensive to manufacture and may be quickly installed and removed.

It is another object of the invention to provide an air vent cover for a building which includes means for holding the cover in place by two spaced screws which after initial installation remain in the structure year round.

It is another object of the invention to provide a building air vent cover which may be formed of either metal or plastic.

In accordance with the invention there is provided a cover for an air vent in a building which is a one piece or integral product formed of sheet metal or plastic material having a central portion sized to fit over the air vent opening, an integral peripheral flange around the central portion adapted to fit against the building surface around the air vent opening, and means in the peripheral flange for releasably securing the cover to the building surface around the opening.

The present invention and its foregoing objects and advantages will be better understood from the following detailed description of a preferred embodiment thereof taken in conjunction with the accompanying drawings wherein.

Figure 1:
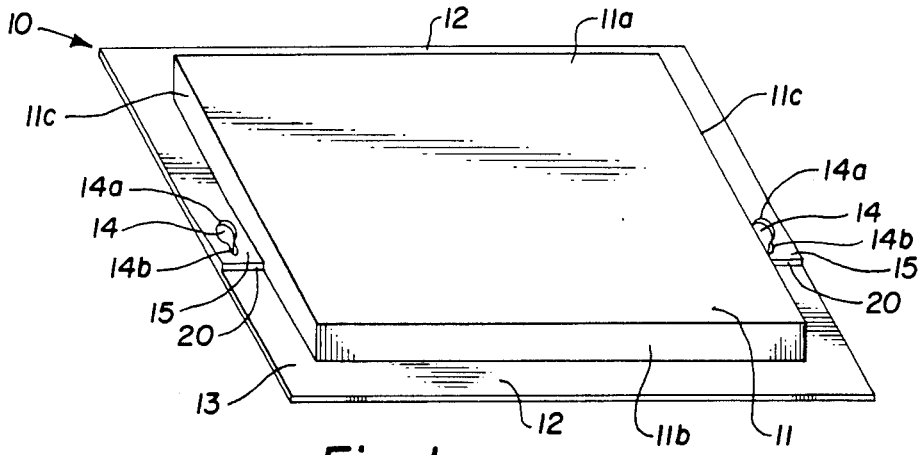
FIG. 1 is a view in perspective of an air vent cover formed in accordance with the invention.

Referring to the drawings, a building air vent cover 10 embodying the features of the invention is an integral product having a central vent opening covering portion 11 and a continuous peripheral flange comprising opposite identical side portions 12 and opposite identical end portions 13. The central portion 11 is an open sided box or hollow open sided parallelopiped formed by a central panel 11*a*, opposite longitudinal sides 11*b* and opposite ends 11*c*. In the particular form of the cover illustrated the opposite sides and ends 11*b* and 11*c* respectively are perpendicular to the central panel 11*a*. The sides and ends are perpendicular to each other whereby the central portion 11 is rectangular in shape. As evident in FIG. 2 the portion 11 is open sided on the back or inside face of the cover to provide space within the cover so that the cover readily fits over a louvre installed in an air vent opening. The flange opposite end portions 13 each has a centrally positioned keyway shaped opening 14 formed by a circular portion 14*a* and a rectangular slot portion 14*b*. The circular portion 14*a* is sized to be larger in diameter than a screw head on a screw used to hold the cover in position over a vent opening. The rectangular slot portion 14*b* of the keyway opening is wider than the diameter of the screw shank and smaller in width than the diameter of the screw head so that when installing the cover the heads of the screws used to hold the cover on may easily pass through the circular opening portions 14*a* and the cover may be laterally shifted to move it to a position at which the screw shanks pass through the slot portions 14*b*. Each of the end flange portions 13 is provided with a latch surface 15 which is an inclined plane or sloping surface beginning along the surface of the flange portion 13 around the keyway portion 14*a* and sloping upwardly or rising to the end edge 20. The flange 13 along the latch surface 15 increases in thickness from the area around the keyway portion 14*a* which is substantially the same thickness as the remainder of the flange portion 13 to a substantially increased thickness at the end edge 20 of the latch surface as is clearly evident in FIG. 3. The latch surface provides a wedging effect with the screw heads when the cover 10 is moved sideways or laterally to shift the keyways until the screw shanks are within the slot portions 14*b* of the keyways. The latch surfaces 15 provide means for releasably securing the vent cover 10 in place without the need for separate moving parts.

The vent cover 10 may be manufactured from a number of different materials. It may be fabricated from sheet metal by stamping or assembly from the required number of parts to provide the configuration needed.

Also it may be molded using a variety of plastic materials to provide a lightweight and strong product.

Figure 2:
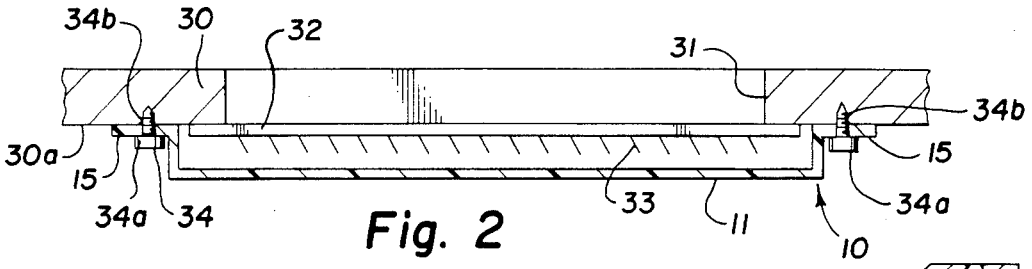
FIG. 2 is a longitudinal view in section as seen along the line 2—2 of FIG. 4 showing the air vent cover installed on a building panel over an air vent opening in the building.
Figure 3:
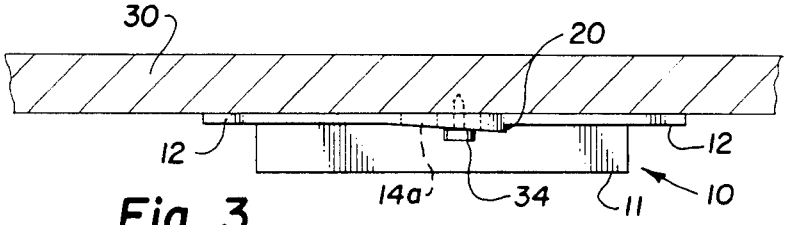
FIG. 3 is a view in section along the line 3—3 of FIG. 4 showing an end view of the air vent cover installed on the building as in FIG. 2.
Figure 4:
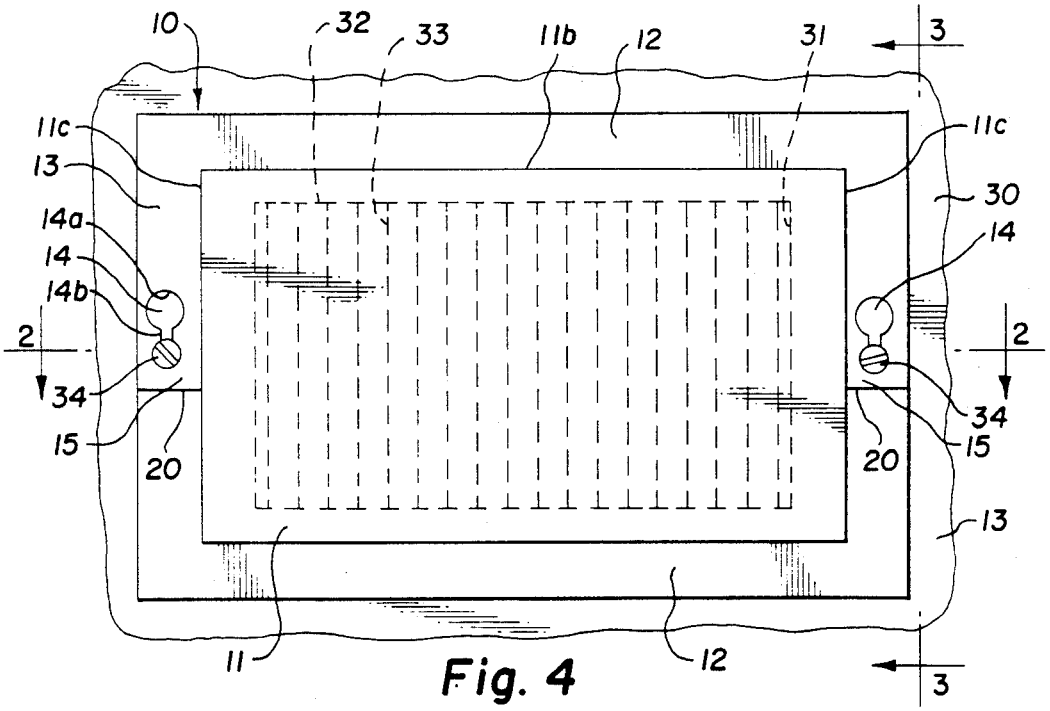
FIG. 4 is a plan view of the air vent cover releasably secured on the building surface over the air vent opening in the building.

Referring to FIGS. 2–4 inclusive, the air vent cover 10 is installed on a building panel 30 provided with an air vent opening 31 covered by a louvre 32. The louvre is provided with a plurality of spaced slanted fins 33 for allowing air flow while deflecting rain, snow and the like. The panel 30 may be along a lower portion of the vertical side wall of a building at the level of the crawl space, a vertical side wall portion of a building beneath the eave opening into the attic, or a horizontal closure panel along enclosed eaves opening into the attic of the building. A pair of screws 34 are installed in the panel 30 at opposite ends of the vent opening 31 approximately midway from opposite sides of the vent opening and longitudinally spaced substantially the same distance as the distance between the center lines of the keyways 14 of the cover 10. The screws are positioned so that they will be in alignment with the round portions 14*a* of the keyways when the cover 10 is positioned over the vent opening so that the enclosure or housing portion 11 of the cover fits over and around the louvre 32 as evident in FIGS. 2 and 4. The screws 34 are screwed into the panel 30 to a depth at which the screw heads 34*a* are spaced from the adjacent surface 30*a* of the panel 30 a slightly greater distance than the thickness of the cover flange end portions 13 at the keyway portions 14*a*. The cover 10 is positioned against the panel 30 with the inside faces of the flange portions 12 and 13 resting against the adjacent face 30*a* of the panel 10. The screw heads 34*a* pass through the keyway portions 14*a*. The cover is then moved in a lateral direction in which the slot portions 14*b* of the keyways move along the shank portions 34*b* of the screws until the exposed portions of the screw shanks between the panel surface 30*a* and the screw heads are each in the respective slot portion 14*b* of the keyways. The inclined latch surface 15 in each of the end flanges wedges beneath the screw heads 34*a* as seen in FIG. 3 holding the cover tightly against the panel surface 30*a* over the louvre 32. The cover fits tightly against the panel around the lourve and vent opening 31 preventing flow of air through the vent opening.

When removal of the vent cover 10 is desired, it is shifted laterally sliding the flange portions 12 and 13 along the surface 30*a* until the screw heads 34 are within the round portions 14*a* of the keyways 14. The screw heads will then easily pass through the keyways as the cover is moved away from the surface 30*a* of the panel 30. The screws are left in the panel for reinstalling the covers when desired. Normally the covers are placed over the building air vent openings primarily during those periods of the year when exclusion of cold air from the building and retention of hot air within the building crawl space and attic are desired. Because of the simplicity of the structure of the cover and the ease of installation and removal, the covers can be placed in position or removed within a few minutes. Due to simplicity of design and lack of moving parts the covers may be manufactured and distributed at minimum cost. Only two screws which may be permanently installed are required for holding the covers in place.

Figure 5:
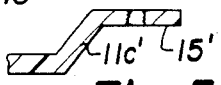
FIG. 5 is a fragmentary section view of an alternate vent cover having sloping side and end walls to facilitate stacking for storage and shipping.

Another embodiment of the cover in FIG. 5 has sloping end walls 11*c*′ and sloping side walls to facilitate stacking in a nested relationship to reduce space requirements for shipping and storage.

It will be recognized that while the central or enclosure portion 11 of the cover which fits over the air vent louvre is shown as rectangular in shape and having perpendicular side walls and ends, changes may be made in the exact shape such as providing sloping side walls and ends joining the side and end flange portions on the cover as well as more rounded corners and edges along which the side walls join the central panel portion 11*a* of the cover. Such minor design changes as will facilitate more easily molding the cover from plastic are intended to be within the scope of the invention. It is only necessary to provide the cover with the mounting flanges and insure that the enclosure portion 11 of the cover is sized and shaped to cover a louvre such as the louvre 32 mounted in a building vent opening.

What is claimed is:

1. A cover for a building air vent comprising: a central hollow cover portion sized to fit around said vent, an integral peripheral flange around said cover portion encompassing an area larger than said vent; securing means in said flange for releasably securing said cover to a surface of a said building around said vent comprising a key-shaped opening in each of the opposite end portions of said peripheral flange for mounting said cover using two spaced screws, each said key-shaped opening having a round portion larger in diameter than a mounting screw and an adjoining rectangular slot portion having a width less than the diameter of the head of said screw and larger than the diameter of the shank of said screw; and each opposite end flange portion of said peripheral flange being provided with a latch surface along an inclined plane around said key-shaped opening sloping to provide a greater thickness of said flange portion along said slot portion of said key-shaped openings.

2. A vent cover in accordance with claim 1 sloping side and end walls for stacking in a nested relationship.

3. A cover for an air vent in a building panel comprising:

a parallelopiped shaped hollow central enclosure portion having a panel larger than said air vent and provided with end said side walls forming with said panel an enclosure larger than a louvre mounted over said air vent, and a peripheral flange having opposite ends and opposite side portions formed integral with said enclosure portion joining said end and said side walls for fitting against said building panel around said vent opening, said end flange portions each being provided with a centrally located keyway opening having a round portion and a substantially rectangular slot portion narrower in width than said round portion, and a latch surface in each of the outer surfaces of said end flange portions, said latch surfaces being provided each on an inclined plane whereby said end flange portion is thicker along said slot portion of said keyway than along said round portion of said keyway to provide a wedging effect with a mounting screw head.

4. A cover in accordance with claim 3 having sloping side and end walls for stacking in a nested relationship.

* * * * *